US007694646B2

(12) United States Patent
Vatanen et al.

(10) Patent No.: US 7,694,646 B2
(45) Date of Patent: Apr. 13, 2010

(54) PAPER/BOARD WEB COATING APPARATUS

(75) Inventors: Heikki Vatanen, Järvenpää (FI); Tapio Pitkäniemi, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 1070 days.

(21) Appl. No.: 10/571,224

(22) PCT Filed: Aug. 30, 2004

(86) PCT No.: PCT/FI2004/050122

§ 371 (c)(1),
(2), (4) Date: Mar. 9, 2006

(87) PCT Pub. No.: WO2005/024132

PCT Pub. Date: Mar. 17, 2005

(65) Prior Publication Data

US 2006/0243200 A1 Nov. 2, 2006

(30) Foreign Application Priority Data

Sep. 10, 2003 (FI) ..... 20035149

(51) Int. Cl.
*B05C 5/02* (2006.01)

(52) U.S. Cl. ..... 118/411; 118/412; 118/429; 118/DIG. 4

(58) Field of Classification Search ..... 118/DIG. 4, 118/410, 411, 412, 429, 325; 427/420; 425/466, 425/467; 222/575, 559, 561; 239/107, 108, 239/104
See application file for complete search history.

(56) References Cited

U.S. PATENT DOCUMENTS 4,937,093 A 6/1990 Chino et al.
5,190,789 A 3/1993 Finnicum
5,545,256 A 8/1996 Fukuda et al.
5,837,324 A 11/1998 Yaoel et al.
6,013,327 A 1/2000 Naruse et al.

(Continued)

FOREIGN PATENT DOCUMENTS

EP 0 838 551 A1 4/1998

(Continued)

OTHER PUBLICATIONS

International Search Report issued in PCT/FI2004/050122, (Nov. 2004).

(Continued)

*Primary Examiner*—Laura Edwards
(74) *Attorney, Agent, or Firm*—Stiennon & Stiennon

(57) ABSTRACT

A coating apparatus, has a nozzle unit (1) with at least one feeding chamber (12) extending in the longitudinal direction (W) of the coating apparatus. Coating color is conveyed into the chamber by feeding means (4), and a nozzle slot (30) in flow communication with the said feeding chamber, the slot also extending in the longitudinal direction (W) of the coating apparatus. The flow communication between the at least one feeding chamber (12) and the nozzle slot (30) is formed by feed holes (14; 18) made in one wall of the feeding chamber, through which the coating color can be conveyed to the nozzle slot. The nozzle unit has means (15, 16; 19) by which the effective area of the feed holes (14; 18) can be adjusted in order to accomplish transverse profiling of the amount of coating color.

15 Claims, 4 Drawing Sheets

U.S. PATENT DOCUMENTS

| | | | | |
|---|---|---|---|---|
| 6,126,751 | A | 10/2000 | Bernert et al. | |
| 6,248,174 | B1 | 6/2001 | Kustermann | |
| 6,248,406 | B1 | 6/2001 | Kondo et al. | |
| 6,471,775 | B1 * | 10/2002 | Becker et al. | 118/325 |
| 7,041,336 | B2 * | 5/2006 | Masuda et al. | 427/256 |

FOREIGN PATENT DOCUMENTS

| | | | |
|---|---|---|---|
| EP | 1 249 533 | A1 | 10/2002 |
| FI | 20035149 | | 3/2005 |
| FI | 20045056 | | 8/2005 |
| JP | 5-104062 | | 4/1993 |
| JP | 6-142590 | | 5/1994 |
| JP | 07-204561 | A | 8/1995 |
| JP | 9-001043 | | 1/1997 |
| JP | 10-128212 | A | 5/1998 |
| JP | 11-090296 | | 4/1999 |
| JP | 2000-176344 | | 6/2000 |
| JP | 2000-343017 | A | 12/2000 |
| JP | 2001-137762 | A | 5/2001 |
| WO | WO 2004/022240 | A2 | 3/2004 |
| WO | WO 2005/024132 | A1 | 3/2005 |
| WO | 2005/080681 | A1 | 9/2005 |
| WO | 2005/080682 | A1 | 9/2005 |

OTHER PUBLICATIONS

Notification of Reasons for Rejection in Japanese Patent App. No. 2006-525849, (Mar. 2009).

Search Report issued in Japanese application No. 2006-553608 from Co-Pending related U.S. Appl. No. 10/598,181, filed Sep. 20, 2006.

International Search Report issued in PCT/FI2005/050051 from Co-Pending related U.S. Appl. No. 10/598,181, filed Sep. 20, 2006.

Written Opinion of the International Searching Authority for PCT/FI2005/050051 from Co-Pending related U.S. Appl. No. 10/598,181, filed Sep. 20, 2006.

* cited by examiner

PAPER/BOARD WEB COATING APPARATUS

CROSS REFERENCES TO RELATED APPLICATIONS

This application is a U.S. national stage application of International App. No. PCT/FI2004/050122, filed Aug. 30, 2004, the disclosure of which is incorporated by reference herein, and claims priority on Finnish App. No. 20035149, filed Sep. 10, 2003.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a paper/board web coating apparatus, which is arranged to extend in its longitudinal direction in the transverse direction of the web to be coated, and which comprises a nozzle unit having at least one feeding chamber extending in the longitudinal direction of the coating apparatus, into which chamber is conveyed coating color by feeding means, and a nozzle slot in flow communication with the said feeding chamber, the said slot also extending in the longitudinal direction of the coating apparatus, and to which slot the coating color is supplied from the feeding chamber over the total longitudinal distance of the nozzle slot and further conveyed out of the outlet opening of the nozzle slot.

The aim of the present invention is to provide an improvement to a curtain coater intended for spreading the coating color of a paper/board web.

The use of a curtain coater for coating paper or board webs is increasing, because it exerts much less force on the web than blade coating/rod coating and, consequently, causes fewer interruptions resulting from the breaking of the web being coated, and thus improves runnability. Curtain coating does not give the same smoothness as blade coating, but the coverage attained is better than that attained with blade coating.

Curtain coaters can be divided into slot-fed and slide-fed coaters. In a slide-fed curtain coater, the coating color is supplied by means of a nozzle unit onto an inclined plane, along which the coating color flows towards the edge of the plane, whereby a curtain is formed as the coating color drips from the edge of the plane.

In slot-fed applicator beams, the coating color is pumped via a manifold into a narrow vertical slot on the lip of which the curtain is formed and drips onto the web. The coating color may be spread in one or more layers.

The curtain thus formed is guided by means of an edge guide, which is located on the edge of the feeding slot/feeding lip, as indicated by its name.

One problem with current coating color curtain coaters is the limited size of the coating color feed channels and, partly due to this, the difficulty of controlling the size of the flow slot. Controlling the transverse profile of the coating color spread on the web to be coated in different situations is problematic also in a prior art curtain coater. Normally, there are no means for controlling the profile. When designing a coating beam, the shape of the feed channels is determined, by means of which the overall profile may be affected. When the properties and/or feeding volume of coating color change, these have a distinct effect on the transverse profile which cannot be corrected. All imprecisions of manufacture also affect the profile irreparably.

SUMMARY OF THE INVENTION

Accordingly, one important aim of the present invention is to provide an improved curtain coater, which makes possible uniform feeding of coating color over the total length of the nozzle unit, in the transverse direction (CD-direction) of the web being coated, the said feeding preferably being adjustable to different coating colors. To achieve this aim, the coating apparatus according to the invention is characterized in that the flow communication between the said at least one feeding chamber and the nozzle slot connected to it is formed by feed holes made in one wall of the feeding chamber, through which the coating color can be conveyed to the nozzle slot, and that the nozzle unit has means by which the effective area of the feed holes can be adjusted in order to accomplish transverse profiling of the amount of coating color.

A further, more general aim of the invention is to provide a spreading apparatus for spreading various fibrous or other liquids or coating colors in a paper/board or pulp machine environment.

The invention is described in greater detail in the following, with reference to the accompanying drawings.

DESCRIPTION OF THE PREFERRED EMBODIMENTS

Figure 1:
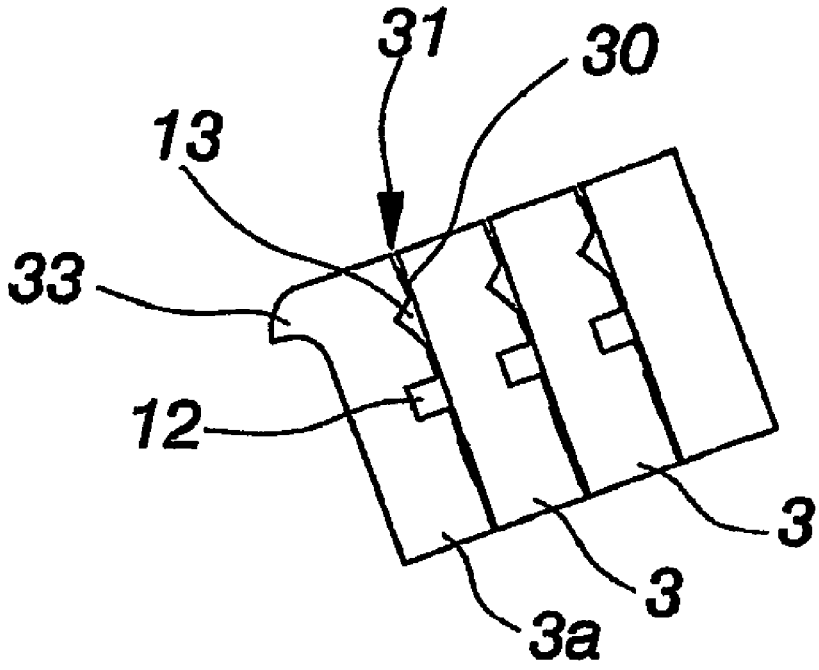
Fig. 1 (Prior art)
FIG. 1 shows a diagrammatic view of a nozzle unit of a multi-layer curtain coater according to the prior art.

FIG. 1 shows diagrammatically the general structure of the nozzle unit of a known slide-fed multi-layer curtain coater. The nozzle unit is comprised of nozzle parts 3 and 3*a*, each of which has a feeding chamber 12 and an equalizing chamber 13, and a nozzle slot 30, which are machined in thick steel plate. The edge 33 of the outermost nozzle part 3*a* forms a feeding lip, over which the coating color discharged from the outlet openings 31 of the nozzle slots 30 and flowing along the upper surface of the nozzle unit is conveyed to form a coating color curtain and to guide it by means of edge guides (not shown) onto the surface of the paper/board web to be coated which is traveling below the coater. The coating color curtain formed extends across the web being coated.

Figure 2:
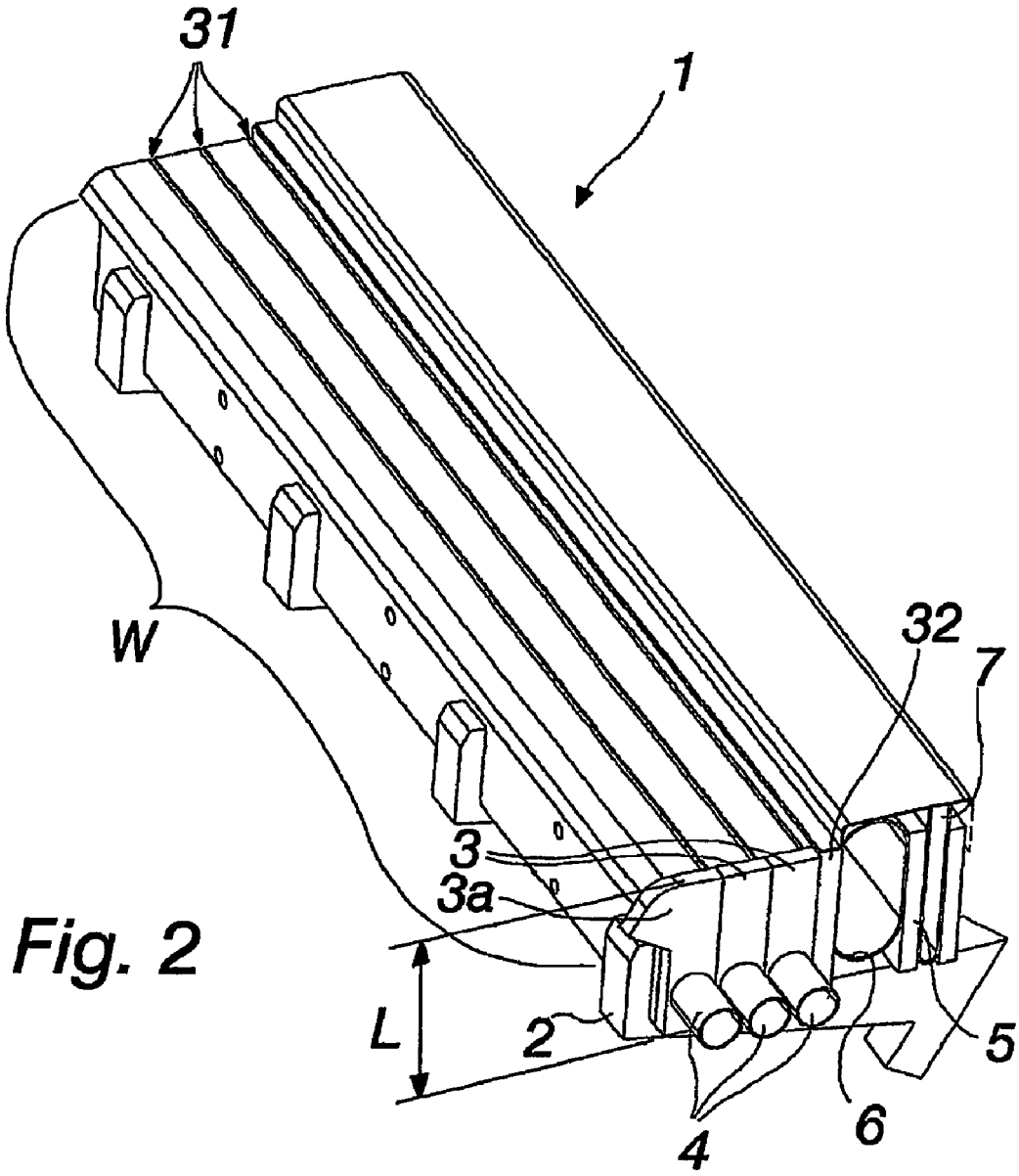
FIG. 2 shows a diagrammatic, perspective view of a nozzle unit of a slide-fed curtain coater, which may be realized in accordance with the invention.

FIG. 2 shows the applicator beam 1 of a slide-fed curtain coater, which can be realized in accordance with the invention. The applicator beam comprises nozzle parts 3, 3*a* and 32 located on bearers 2 forming a supporting structure, the said nozzle parts together forming a nozzle unit, which has three nozzle slots 30 in the embodiment shown that make multi-layer coating possible. The nozzle parts 3 and 32 are arranged movably on top of the bearers 2. In order to move the movable nozzle parts 3, 32, the curtain coater comprises a fixed support 5 resting on the bearers 2, on the other side of the said support, between the innermost nozzle part 32 and the fixed support 5, is a closing tube 6, and on the opposite side of the fixed support 5 an opening tube 7, whereby by pressurizing the closing tube 6, the movable nozzle parts 3, 32 can be made to move towards the fixed nozzle part 3*a* to close the nozzle unit, and by releasing the pressure from the closing tube 6 and pressurizing the opening tube 7, the movable nozzle parts 3, 32 can be made to move away from the fixed nozzle part 3*a* to open the nozzle unit, for example, to remove dried coating color from the nozzle slot and/or the different chambers of the nozzle.

At one end of the nozzle unit are arranged feeder pipes 4 for the coating color being fed, the said pipes opening into the feeding chambers. The substance being fed travels along the feeding chamber towards the opposite end, at which is optionally arranged a by-pass. When proceeding in the feeding chamber, the substance being fed moves at each point over the length of the feeding chamber to the equalizing chamber, and from there further to the nozzle slot 30, over the total longitudinal distance of the nozzle slot 30.

Figure 3:
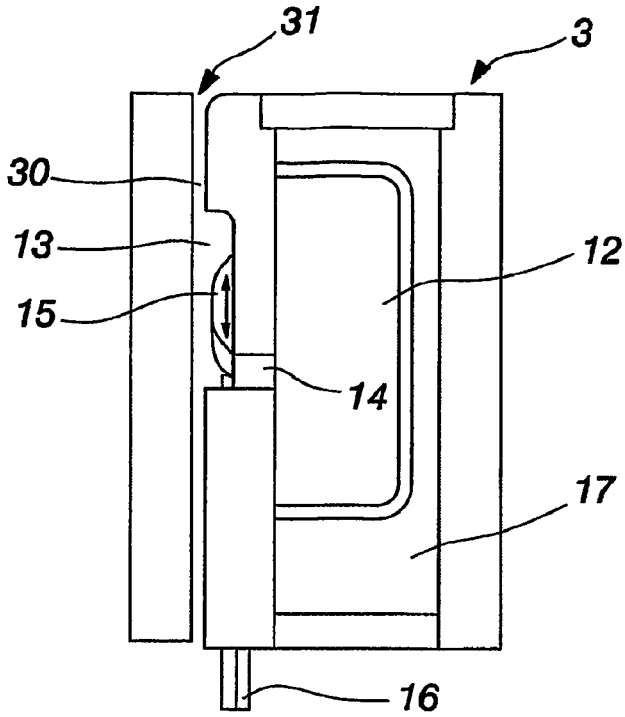
FIG. 3 shows a diagrammatic, cross-sectional view of an embodiment of a nozzle part in a coater according to FIG. 2, the nozzle part comprising a feeding chamber and a nozzle slot.
Figure 4:
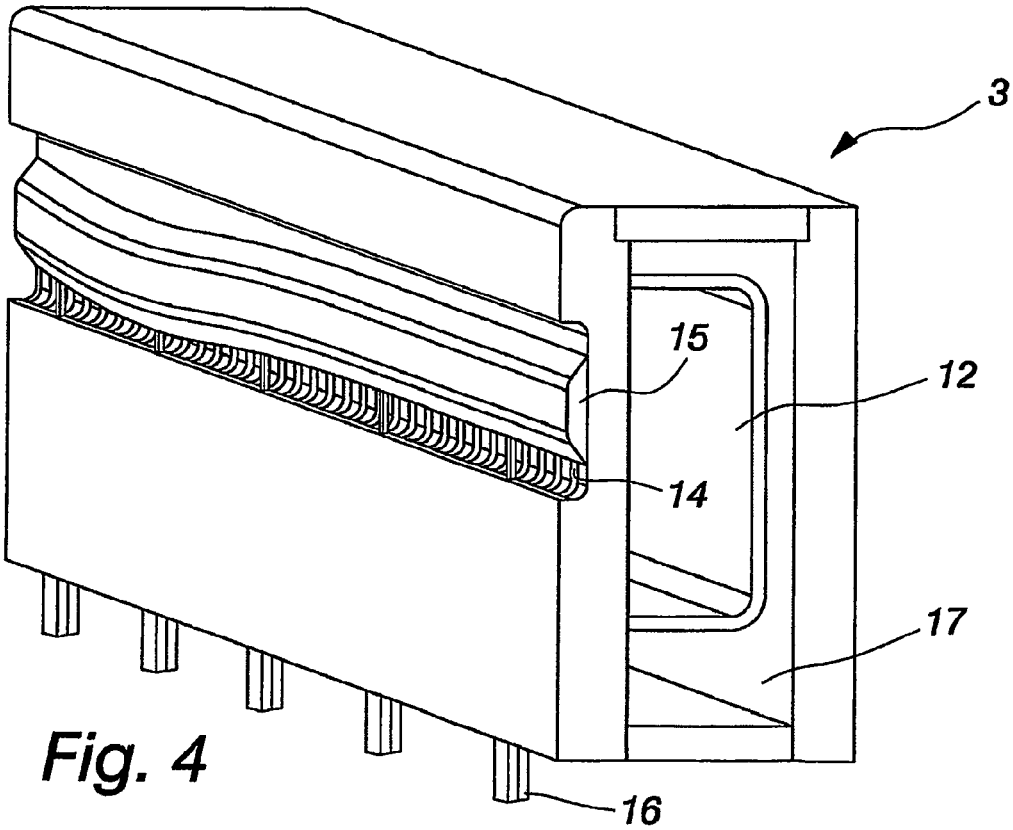
FIG. 4 shows a perspective view of the nozzle part according to FIG. 3.

FIGS. 3 and 4 show one nozzle part solution according to the invention, in which there are feed holes 14 between the feeding chamber 12 and the equalizing chamber 13. The aim being to achieve as even as possible a profile for the substance flowing out of the nozzle, in the equalizing chamber 13 is arranged a profiling member 15, which is located on the surface of the equalizing chamber 13 comprising the feed holes 14, and extends over the length determined by the successive feed holes. The transverse position of the profiling member is adjustable in order to change the effective area of individual feed holes or groups of several feed holes for feeding the desired amount of coating color into the equalizing chamber 13 at different points of its longitudinal direction. The transverse position of the profiling member can be changed by means of adjustment means 16, the operation of the adjustment means preferably being automated, whereby profiling during running will also be possible in the transverse direction of the object being coated. The mutual distance between the adjustment means in the longitudinal direction W of the nozzle part is, for example, 100-600 mm, preferably 150-300 mm. Reference numeral 17 denotes the water-space surrounding the feeding chamber. The profiling member makes it possible to control a considerably larger feed volume area with the same system of coating color feed channels as a normal construction without adjustment. The profiling member also substantially reduces the accuracy of manufacture of the feed slot, and by means of it the transverse profile can be accurately adjusted to be correct regardless of the properties of the coating color and rates of flow. An additional advantage of the solution using a profiling member is that the equalizing chamber becomes a two-step one, which evens out any streaks resulting from the feed holes extremely efficiently. The structure is easy to implement in all feed slots, whereby all layers can be profiled irrespective of each other. The adjustment means 16 connected to the different feed slots are preferably at different longitudinal positions in successive feed slots, in which case they will not cause cumulative waviness to the overall profile of the coating color.

Figure 5:
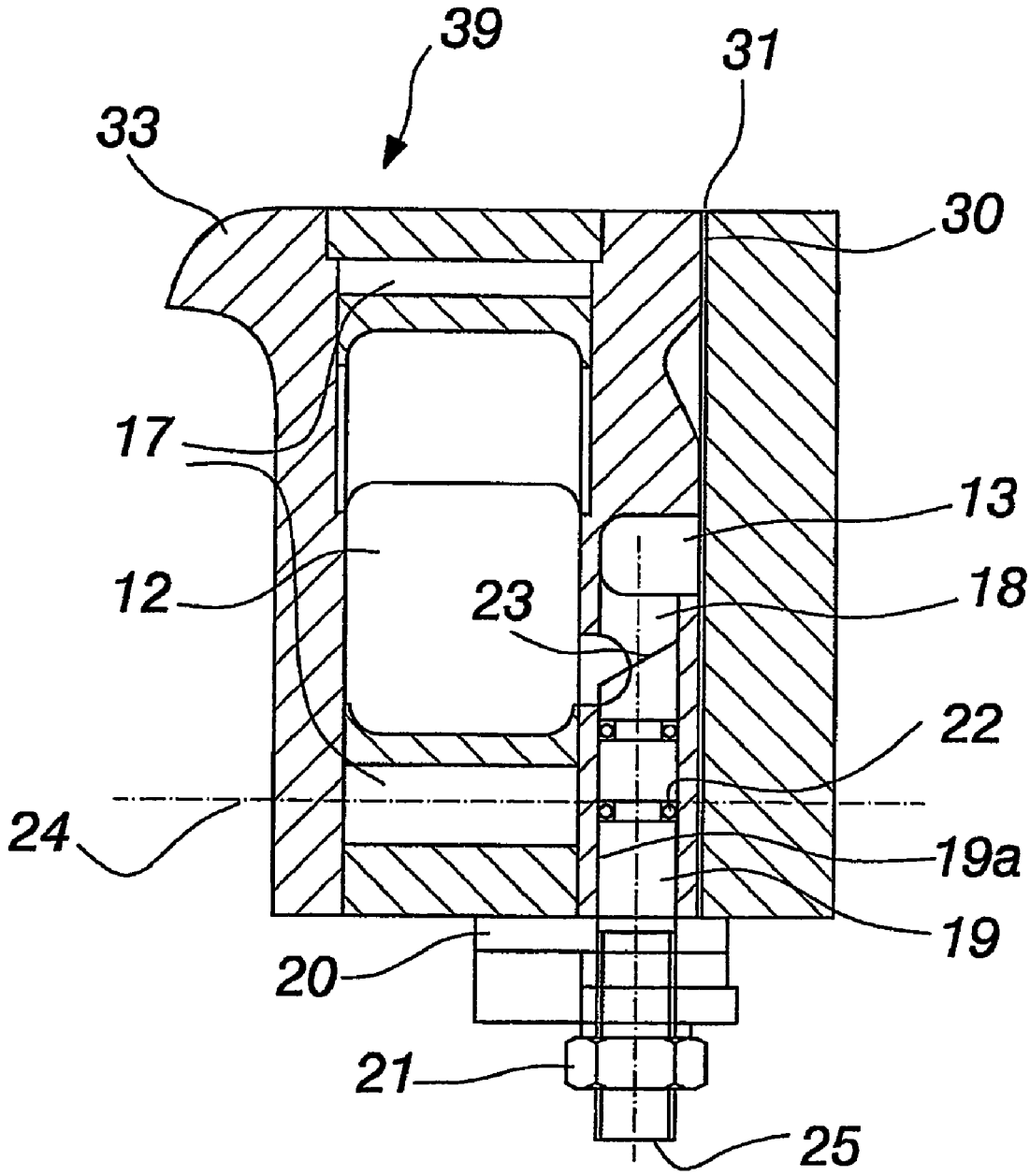
FIG. 5 shows a diagrammatic, cross-sectional view of another embodiment of the nozzle part of the nozzle unit of the curtain coater according to FIG. 2.

FIG. 5 shows another nozzle part solution 39 according to the invention, where feed holes 18 are formed in the feeding chamber 12 at a distance from each other in the longitudinal direction of the nozzle part, through which holes the coating color is conveyed to the equalizing chamber 13. The feeding chamber 12 and the equalizing chamber 13 extend essentially over the total length of the nozzle part. In the embodiment shown, the feed hole 18 forms an angle between the feeding chamber 12 and equalizing chamber 13 and opens in the position shown in FIG. 5 horizontally into the feeding chamber 12 and vertically into the equalizing chamber 13. In addition, a bore 19*a* is formed in each feed hole 18 which opens to the outside of the nozzle part. The bore 19*a* connects with the vertical part of the feed hole 18. A longitudinally movable adjusting pin 19 is arranged in the bore 19*a*. The inner end 23 of the adjusting pin 19 extends into the feed hole 18, and is preferably beveled. At the outer end 25 of the adjusting pin 19 is arranged an adjustment nut 21, by turning which the adjusting pin 19 can be moved in its longitudinal direction in order to change the effective cross-sectional area of the feed hole 18. In connection with the adjusting pin is arranged an adjustment plate 20, in which case, by removing the adjustment plate, the basic setting of the effective cross-sectional area of the feed hole can be changed to reduce the feed volume. The adjusting pin 19 is sealed in the bore 19*a* by means of gaskets 22. The mutual distance between the feed holes 18 in the longitudinal direction of the nozzle part is, for example, 100-600 mm, preferably 150-300 mm, for accomplishing the desired transverse profiling by changing the effective cross-sectional area of the feed holes. The operation of the adjusting pins is preferably automated, whereby profiling during running will also be possible in the transverse direction of the object being coated. Reference numeral 24 denotes the level of attachment of the assembly screws of the nozzle part. The assembly screws extend between successive bores 19*a* across the water-space 17 provided with the gasket means required.

The solution according to the invention may be realized as a single- or multi-layer coating apparatus, where the number of nozzle slots 30 may be, for example, one to twenty-four.

The invention claimed is:

1. A paper or board web curtain coater comprising;

a nozzle unit having portions forming a longitudinally extending nozzle slot for coating color, and having a feeding chamber separated from the slot by a feeding chamber wall, the nozzle slot and the feeding chamber together extending in a longitudinal direction transverse to the paper or board web to be coated;

a feeder pipe arranged for conveyed coating color into the feeding chamber;

portions of the feeding chamber wall forming a plurality of successive feed holes having effective areas and spaced in the longitudinal direction, through which coating color can be conveyed from the coating chamber to the nozzle slot; and at least one structure movably mounted in the nozzle unit so that motion of the at least one structure is arranged to control flow of color coating from the feeding chamber through the feed holes to the nozzle slot, wherein the at least one structure is arranged to vary flow through the feed holes to accomplish transverse profiling of coating color flowing from the slot;

wherein portions of the nozzle unit between said feed holes and the nozzle slot, form at least one equalizing chamber which also extends in the longitudinal direction of the coating apparatus so that the feed holes open into the equalizing chamber; and wherein the at least one structure movably mounted in the nozzle unit is a structure arranged in the equalizing chamber, said structure being positioned on a surface forming the equalizing chamber, said surface formed by portions of the feeding chamber wall through which the feed holes extend, and wherein the structure extends over a plurality of successive feed holes, said structure comprising a profiling member which is adjustable to change the effective areas of individual feed holes or groups of several feed holes for feeding a desired amount of coating color into the equalizing chamber at different points along the equalizing chamber in the longitudinal direction.

2. The coater of claim 1, further comprising adjustment means for adjusting the profiling member, which means for adjusting including adjusting bolts extending from an outer surface of the nozzle unit to the equalizing chamber, by means of which the profiling member can be deviated perpendicularly to the longitudinal direction so as to cover or uncover the feed holes to a selected extent.

3. A paper or board web curtain coater comprising;

a nozzle unit having portions forming a longitudinally extending nozzle slot for coating color, the nozzle slot terminating in an outlet opening that opens on to an upper surface of the nozzle unit, the nozzle unit having a feeding chamber separated from the slot by a feeding chamber wall, the nozzle slot, upper surface, and the feeding chamber together extending in a longitudinal direction transverse to the paper or board web to be coated;

wherein the upper surface of the nozzle unit extends to a feeding lip arranged such that coating color discharged from the outlet openings flows along the upper surface of the nozzle unit to the feeding lip to form a coating color curtain;

a feeder pipe arranged for conveying coating color into the feeding chamber;

portions of the feeding chamber wall forming a plurality of successive feed holes having effective areas and spaced in the longitudinal direction, through which coating color can be conveyed from the coating chamber to the nozzle slot; and a plurality of adjusting pins, the adjusting pins having axes along which the pins extend, one of said plurality of adjusting pins connected to each feed hole respectively, each pin having an end movable in the axial direction of the pin and arranged for variably changing the effective area of each feed hole.

4. The coater of claim 3, wherein each feed hole forms a bore opening exteriorly to the nozzle unit and opposite the longitudinally extending nozzle slot, in which bore the adjusting pin is located movably in its axial direction, to extend an end into the feed hole for changing its effective cross-sectional area.

5. The coater of claim 4, wherein the end is beveled of each adjusting pin for variably changing the effective area of each feed hole.

6. The coater of claim 3, further comprising a plurality of nozzle units joined together to form a plurality of feed slots opening on to a common surface to form a multi-layer coating apparatus;

wherein the pins extend in a direction opposite the plurality of longitudinally extending nozzle feed slots so that the plurality of nozzle units can be joined so that the plurality of feed slots open on to a common surface.

7. A paper or board web noncontact curtain coater, comprising:

a nozzle unit having an upper surface, and portions forming a longitudinally extending nozzle slot for coating color, said slot opening on to the upper surface;

a feed lip extending from the upper surface arranged so that color flowing from the nozzle slot along the upper surface to the feed lip forms a color curtain;

a feeding chamber contained within the nozzle unit, the feeding chamber separated from the slot by a feeding chamber wall, the nozzle slot and the feeding chamber together extending in a longitudinal direction transverse to the paper or board web to be coated;

a feeder pipe in color supplying relation arranged for conveyed coating color into the feeding chamber;

portions of the feeding chamber wall forming a plurality of successive feed holes having effective areas, and spaced in the longitudinal direction, through which coating color can be conveyed from the feeding chamber to the nozzle slot; and at least one structure movably mounted in the nozzle unit so that motion of the at least one structure is arranged to control flow of color coating from the feeding chamber, through the feed holes to the nozzle slot, wherein the at least one structure is arranged to vary flow through the feed holes to accomplish transverse profiling of coating color flowing from the nozzle slot;

wherein portions of the nozzle unit between said feed holes and the nozzle slot, form at least one equalizing chamber which also extends in the longitudinal direction of the coating apparatus so that the feed holes open into the equalizing chamber; and wherein the at least one structure movably mounted in the nozzle unit is a structure arranged in the equalizing chamber, said structure being positioned on a surface forming the equalizing chamber, said surface formed by portions of the feeding chamber wall through which the feed holes extend, and wherein the structure extends over a plurality of successive feed holes, said profiling member being adjustable to change the effective areas of individual feed holes for feeding a desired amount of coating color into the equalizing chamber at different points along the equalizing chamber in the longitudinal direction.

8. The coater of claim 7, further comprising adjustment means for adjusting the profiling member which means for adjusting includes adjusting bolts extending from an outer surface of the nozzle unit to the equalizing chamber, by means of which the profiling member can be deviated perpendicularly to the longitudinal direction so as to cover or uncover the feed holes to a selected extent.

9. A paper or board web curtain coater, comprising:

a feeder pipe for conveying coating color;

a nozzle unit having portions defining a feeding chamber which is in communication with the feeder pipe;

a feeding chamber wall having portions defining a plurality of feed holes having effective areas, the feed holes being in communication with the feeding chamber and being spaced in a longitudinal direction which is transverse to a web being coated;

portions of the nozzle unit which define a longitudinally extending nozzle slot, the nozzle slot arranged to supply coating color so that a curtain is formed as the coating color drips from the paper or board web curtain coater;

portions of the nozzle unit which define a first chamber extending from the plurality of feed holes to the nozzle slot, such that coating color supplied from the feeding chamber passes through the feed holes to the first chamber and out the nozzle slot for application to the web, wherein the nozzle slot and the feeding chamber extend in the longitudinal direction; and at least one member movable within the nozzle unit to adjustably reduce the effective areas of the plurality of feed holes and thereby control flow of coating color from the feeding chamber though the feed holes to the nozzle slot, wherein the at least one movable member permits the varying of flow through the feed holes to accomplish transverse profiling of coating color flowing from the slot;

wherein the at least one member movable within the nozzle unit comprises a single profiling member mounted within the first chamber, the single profiling member being connected to a plurality of adjusting bolts extending from an outer surface of the nozzle unit to the equalizing chamber which are adjustable to cause the profiling member to move within the first chamber to cover portions of the feed holes in order to change the effective area of individual feed holes or groups of several feed holes.

10. A paper or board web curtain coater comprising:

a nozzle unit having portions forming a longitudinally extending nozzle slot for coating color, the nozzle slot terminating in an outlet opening that opens on to an upper surface of the nozzle unit, the nozzle unit having a feeding chamber separated from the slot by a feeding chamber wall, the nozzle slot, upper surface, and the feeding chamber together extending in a longitudinal direction transverse to the paper or board web to be coated;

wherein the upper surface of the nozzle unit extends to a feeding lip arranged such that coating color discharged from the outlet openings flows along the upper surface of the nozzle unit to the feeding lip to form a coating color curtain;

a feeder pipe arranged for conveyed coating color into the feeding chamber;

portions of the feeding chamber wall forming a plurality of successive feed holes having effective areas and spaced in the longitudinal direction, through which coating color can be conveyed from the coating chamber to the nozzle slot;

a plurality of adjusting pins, the adjusting pins having axes along which the pins extend, one of said plurality of adjusting pins connected to each feed hole respectively, each pin having an end movable in the axial direction of the pin and arranged for variably changing the effective area of each feed hole; and wherein the pins extend in a direction opposite the longitudinally extending nozzle slot such that an additional nozzle unit can be added to the nozzle unit with upper surfaces which lead color coating to flow to the feeding lip.

11. The coater of claim 10 wherein the plurality of adjusting pins are each adjustable within a bore which communicates with a feed hole, each pin having an inner end which extends into a feed hole.

12. The coater of claim 11 wherein each pin inner end is beveled.

13. A paper or board web curtain coater comprising:

a plurality of nozzle units, each nozzle unit having a feed chamber connected to a corresponding nozzle feed slot, the nozzle units being joined together to form a cross machine direction extending nozzle beam defining an upwardly facing inclined flow plane intersected by the nozzle feed slots;

a feed lip forming part of the nozzle beam, the feed lip in coating flow receiving relation to the flow plane, the feed plane and feed lip arranged so that a plurality of coating layers, one from each feed slot, form a plurality of superpositioned layers which flow over the feed lip and form a coating curtain which falls from the feed lip;

one feeder pipe for each nozzle unit, the feeder pipes arranged for conveyed coating color into each feeding chamber;

portions of each feeding chamber wall which define a plurality of successive feed holes, each having an effective area and the successive feed holes spaced in the longitudinal direction and through which coating color can be conveyed from the coating chamber to the corresponding nozzle feed slot;

a plurality of adjusting pins, the adjusting pins having axes along which the pins extend, one of said plurality of adjusting pins connected to each feed hole respectively, each pin having an end movable in the axial direction of the pin and arranged for variably changing the effective area of the feed hole with which it is connected;

wherein the plurality of nozzle units are arranged so that each nozzle unit is closely spaced about a vertical plane from an adjacent one of said nozzle units so that nozzle units are positioned one after another in a machine direction; and wherein the plurality of adjusting pins extend downwardly and opposite the upwardly facing flow plane so that the adjusting pins allow the plurality of nozzle units to be joined together in the nozzle beam to define the upwardly facing flow plane intersected by the nozzle feed slots.

14. The coater of claim 13, wherein each feed hole forms a bore opening exteriorly to the nozzle unit, in which bore the adjusting pin is located movably in its axial direction, to extend an end into the feed hole for changing its effective cross-sectional area.

15. The coater of claim 13, wherein the end of each adjusting pin is beveled.

* * * * *

UNITED STATES PATENT AND TRADEMARK OFFICE

CERTIFICATE OF CORRECTION

PATENT NO. : 7,694,646 B2
APPLICATION NO. : 10/571224
DATED : April 13, 2010
INVENTOR(S) : Vatanen et al.

It is certified that error appears in the above-identified patent and that said Letters Patent is hereby corrected as shown below:

In column 6, line 67, "though the feed holes" should be --through the feed holes--.

Signed and Sealed this

Sixteenth Day of November, 2010

David J. Kappos

David J. Kappos
*Director of the United States Patent and Trademark Office*